US005437495A

United States Patent [19]

Wu

[11] Patent Number: 5,437,495

[45] Date of Patent: Aug. 1, 1995

[54] FLEXIBLE MULTI-DIRECTION BEAUTY SALON CHAIR

[76] Inventor: Jung-Te Wu, No. 6, Lane 56, Woa-Yau Road, Dah-Li Shiang, Taichung, Taiwan

[21] Appl. No.: 176,568

[22] Filed: Dec. 30, 1993

[51] Int. Cl.[6] ..... A47C 15/00

[52] U.S. Cl. ..... 297/241; 297/240; 297/344.13; 297/344.2; 297/344.23

[58] Field of Search ..... 297/240, 241, 257, 344.1, 297/344.12, 344.13, 344.2, 344.24, 344.23, 344.17

[56] References Cited

U.S. PATENT DOCUMENTS 2,524,187 10/1950 Boles ..... 297/241
2,596,561 5/1952 Johnson et al. ..... 297/241
2,602,485 7/1952 Alloway ..... 297/240
4,863,217 9/1989 Fountain ..... 297/241

*Primary Examiner*—Laurie K. Cranmer
*Attorney, Agent, or Firm*—Lowe, Price, LeBlanc & Becker

[57] ABSTRACT

The present device relates to a new design of beauty salon chair, particularly a flexible multi-direction beauty salon chair that can move in different directions automatically, primarily driven by control circuits connected to sets of guiding rod. That the working chair of cosmetician or hair stylists can move in different directions through circuit control is the main characteristic of the present invention. Professionals in cosmetology can avoid longtime standing while working with the above described invention.

1 Claim, 7 Drawing Sheets

FLEXIBLE MULTI-DIRECTION BEAUTY SALON CHAIR

BACKGROUND OF THE INVENTION

1. Field of the Invention

The present invention relates to a new design of beauty salon chair, in particular a flexible multi-direction beauty salon chair that can move in different directions automatically. The chair is primarily driven by control circuits connected to sets of guiding rods. The characteristic of the invention is the chair of cosmetician that can move in different directions through circuit control. By that, the cosmetician can avoid standing while working.

2. Description of the Prior Art

Most hair stylists and cosmetician have to stand while working. However, longtime standing creates fatigue and various health problems. Hair stylists and cosmetician can suffer bodily injuries in long term. Although some professionals use seats, cosmetology is a profession that requires frequent change in working position. Poor mobility of the chair can hamper job convenience. Therefore, a chair that can provide comfort and convenience for professionals is an important subject to study.

SUMMARY OF THE INVENTION

The main object according to the present invention is to provide a beauty salon chair that reduces adverse health problems suffered by cosmetician and hair stylists due to longtime standing when doing their job.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
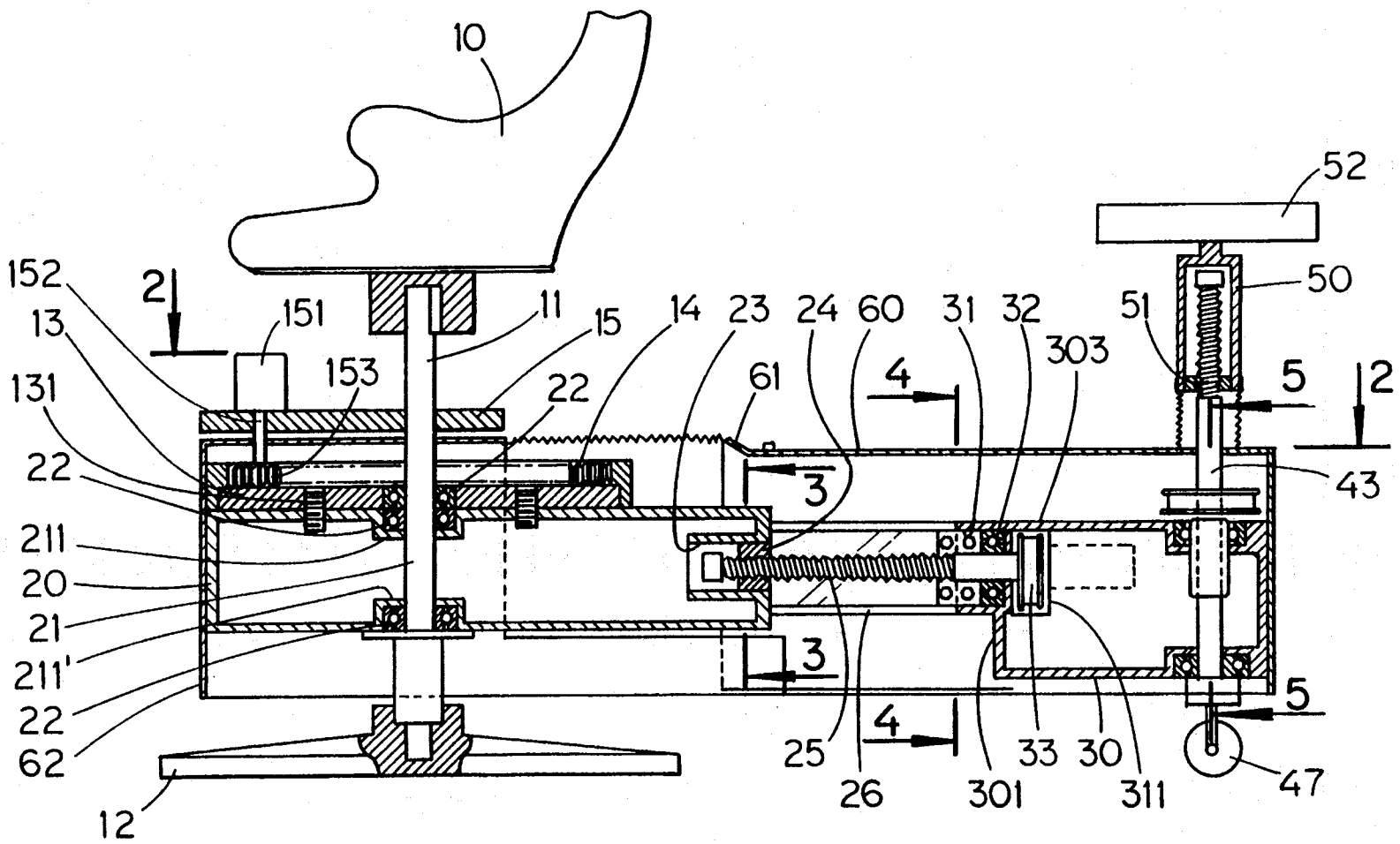
FIG. 1 is a preferred diagrammatic view of the structure of the present invention.
Figure 2:
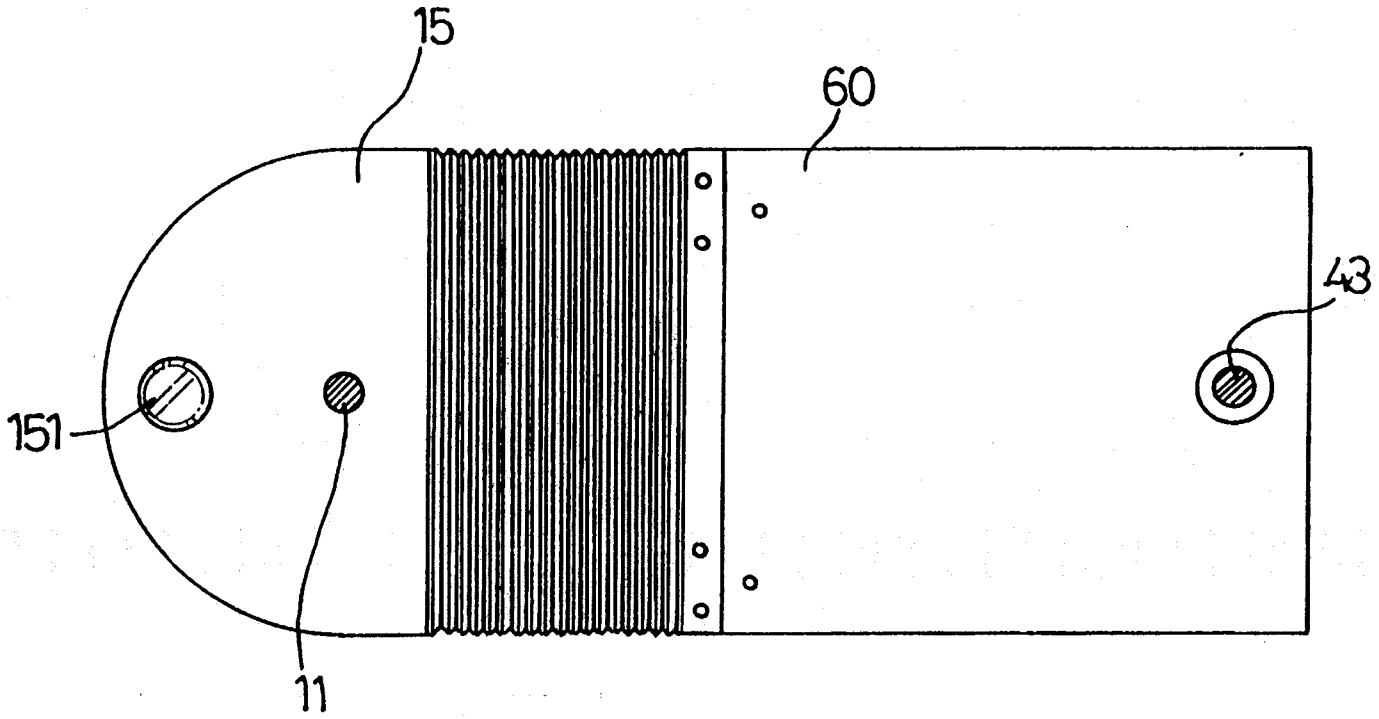
FIG. 2 is a sectional view, along section 2—2 of FIG. 1.
Figure 3:
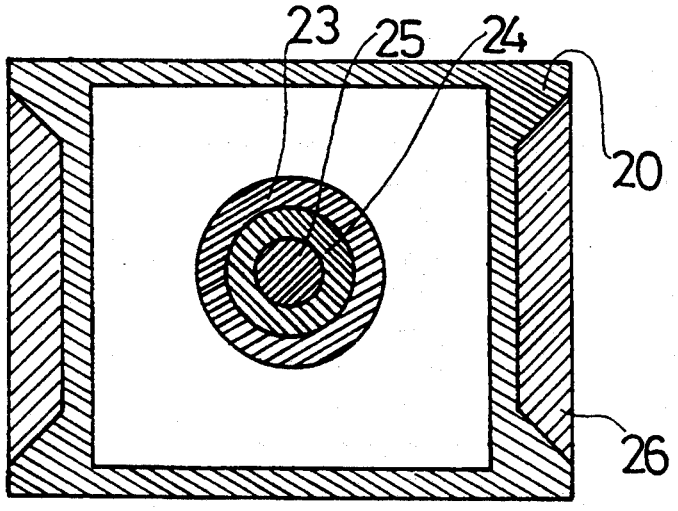
FIG. 3 is a sectional view, along section 3—3 of FIG. 1.
Figure 4:
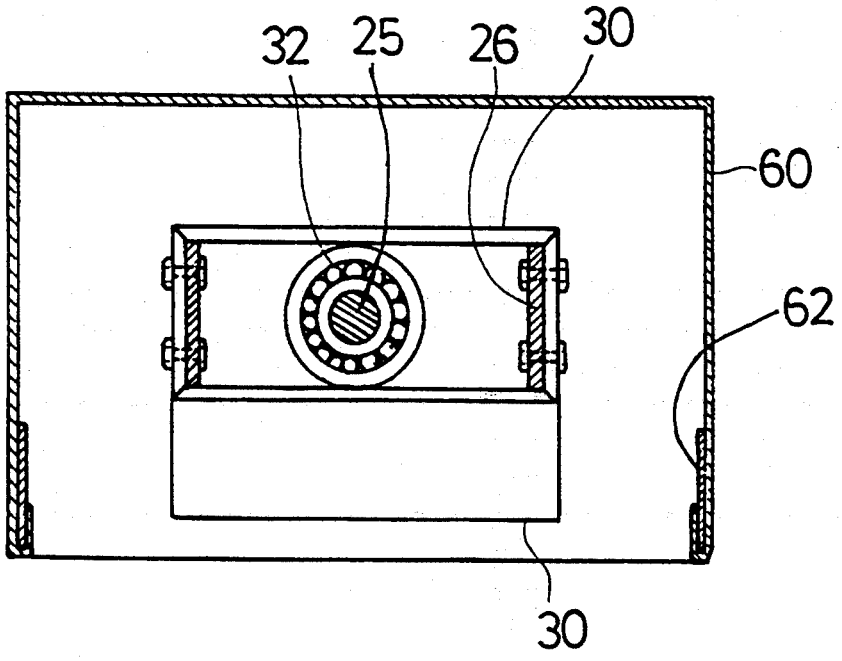
FIG. 4 is a sectional view, along section 4—4 of FIG. 1.
Figure 5:
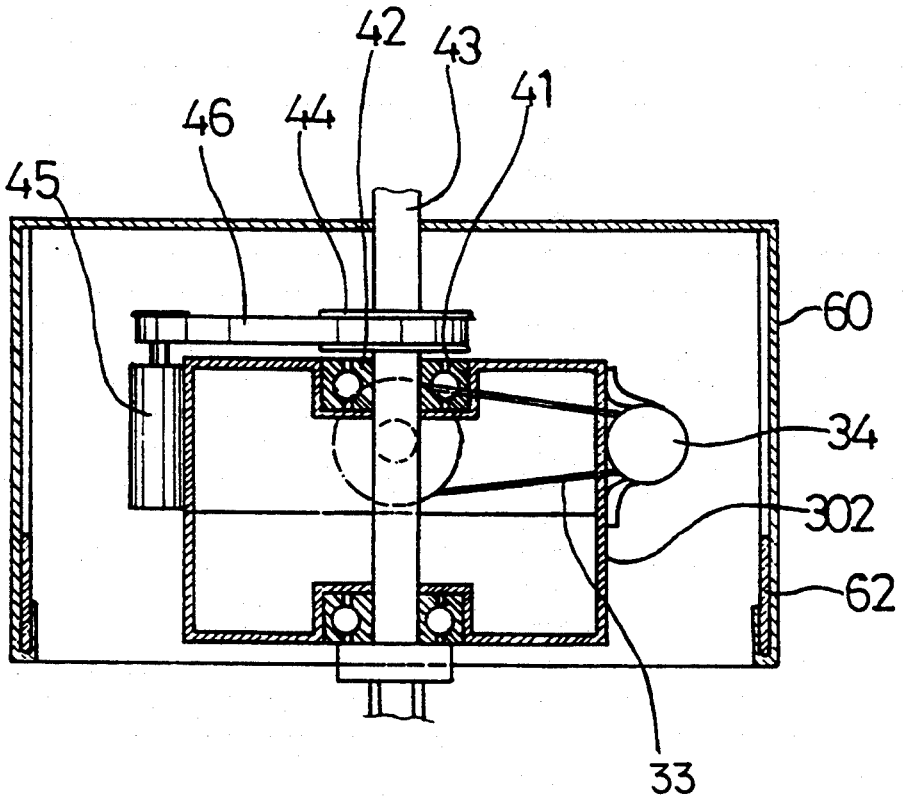
FIG. 5 is a sectional view, along section 5—5 of FIG. 1.

AS shown in FIG. 1 through FIG. 5, the present invention consists of a chair (10) and a support arm (20). A vertical rod (11) is mounted underneath the chair (10) at one end and secured to a base (12) at the opposite end. The support arm (20) surrounds an axle portion (21) of rod 17 longitudinally. The opposite ends of the axle portion (21) are fitted with shoulders (211) for receiving axle support bearings (22) in place. The support arm (20) also has a column (23) horizontally. No. 1 ring gear (24) inside the column (23) is axially connected to No. 1 threaded rod (25). The top portion of the support arm (20) is secured to a base board (13) by a connecting device (131). The base board (13) itself is provided with a moving internal ring gear (14). In addition, the support arm (20), the base board (13) and the vertical rod (11) together serve as a movable axial connection system. Part of the vertical rod (11) that is between the chair (10) and the internal gear (14) is secured to a partition board (15). No. 1 motor (151) is mounted appropriately on the top surface of the partition board (15). Its driving axle extends to a gear (153) through the partition board (15). The gear (153) is in mesh with the internal ring gear (14). Besides, the portion of the vertical rod (11) between the bottom of the support arm (20) and the base (12) has an outside diameter larger than the inside diameter of the axle (21) to help the support arm (20) fix its position. A guiding plate (26) is installed on the exterior of one side of the support arm (20). It can move in relation to the support arm (20) on the same horizontal line. The other side of the guiding plate (26) is attached to a hanging arm (30).

The hanging arm (30) has a guiding hole (31) on one side. Inside the guiding hole (31) a threaded rod (25) is fitted with an axle support (32). The intersection between the front (301) and the side (302) of the guiding hole (31) has an opening (311) at which No. 1 threaded rod (25) is axially connected to No. 2 gear belt (33). Next to the opening (311), No. 2 motor (34) is mounted on the hanging arm (30). It drives No. 2 gear belt (33) and rotates No. 1 threaded rod (25) by a teeth-shaped belt (46). A hole is drilled (41) longitudinally on the top of the hanging arm (30), away from the guiding hole (31). The central axial line of the drilled hole (41) is perpendicular to that of the guiding hole (31). Also both ends of the drilled hole (41) are provided with axle supports (42) that are fitted axially with No. 2 threaded rod (43). A tube (50) stands upon No. 2 threaded rod (43). Inside the tube (50) ring gear (51) is connected to No. 2 threaded rod (43). A working chair (52) is mounted on top of the tube (50). Part of No. 2 threaded rod (43) that is between the drilled hole (41) and the tube (50) is connected axially to No. 3 gear belt (44). No. 3 motor (45) is mounted to the exterior of the hanging arm (30) adjacent to the drilled hole (41). It drives No. 3 gear belt (44) and rotates No. 2 threaded rod (43) by of the teeth-shaped belt (46). The bottom of the hanging arm (30) is secured to a multi-direction wheel (47) that is mounted on the central axial line of No. 2 threaded rod (43). In addition, a casing (60),extending toward the vertical rod (11) till it reaches its exterior, surrounds the exterior of the hanging arm (30). It creates space to embrace the support arm (20) and the hanging arm (30). Next to an opening of the casing (60) at least a panel of control buttons (61) is installed on the top surface of the casing (60). The buttons (61) are connected by circuits with No. 1 motor (151), No. 2 motor (34) and No. 3 motor (45) respectively for motion control. A revolving cover board (62) is provided to cover part of the vertical rod (11) which is between the partition board (15) and the base (12) in order to contain the internal gear (14), the base board (13) and the support arm (20). One side of the cover board (62) and the casing (60) together form a flexible cover unit resting in relative position on the same horizontal line.

Figure 6A:
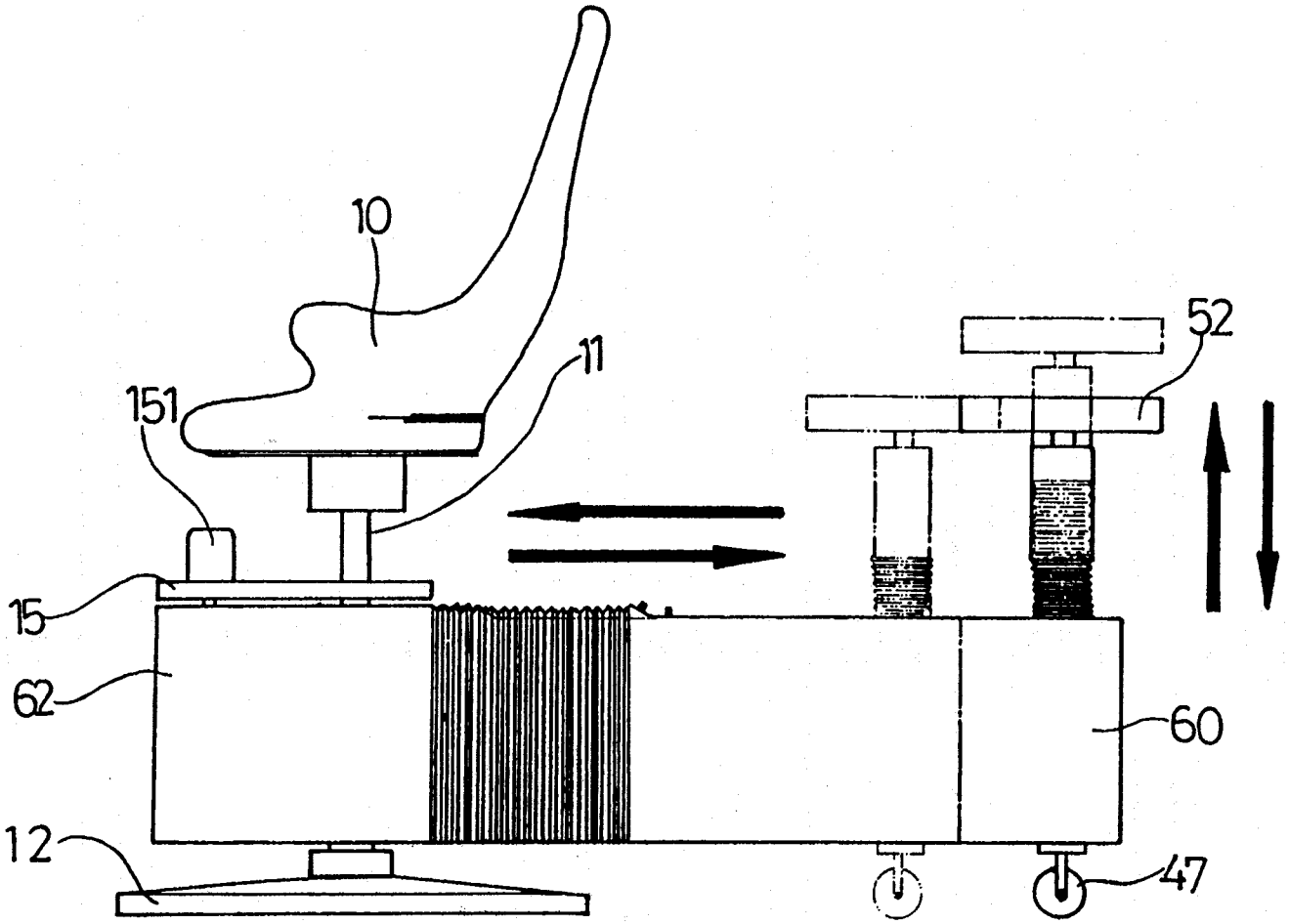
FIG. 6A and 6B are diagrammatic views of the present invention in operation.
Figure 6B:
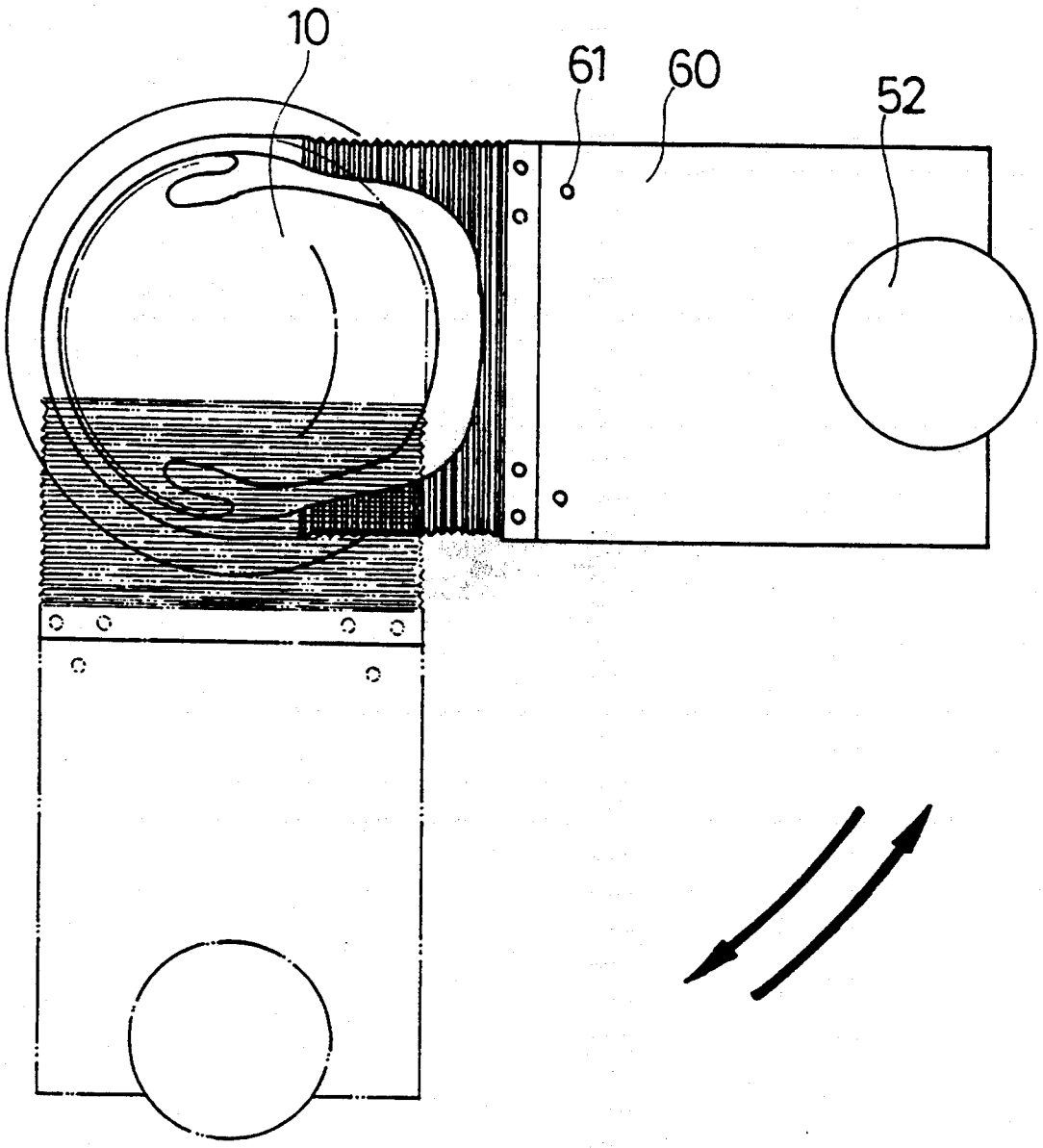

As shown in FIG. 6A and 6B, No. 1 motor (151) and the partition board (15) are secured to the vertical rod (11), and the bottom of the hanging arm (30) is provided with the multi-direction wheel (47). When gear (153) connected to No. 1 motor (151) rotates, it drives the internal ring gear (14) and the hanging arm (30) and the working chair (52) move relative to the chair (10). Besides, starting No. 2 motor (34) enables the teeth-shaped belt (33) to rotate No. 1 threaded rod (25) and the hanging arm (30) on top. Also, starting No. 3 motor (45) rotates No. 2 threaded rod (43) by the teeth-shaped belt (46) and moves the working chair (52) longitudinally. Therefore, by controlling the speed and direction of the motors using a control pedal (61), the distance between the working chair (52) and the chair (10) can be adjusted, the height of the working chair (52) can be changed, or the working chair (52) can be moved in relation to the movement of the chair (10). Hair stylists and cosmetician can then avoid longtime standing doing their job. In addition, sitting while working using the present invention can increase job convenience by changing the position quickly. Adverse health effects of the job can then be avoided.

The above described technical characteristics and detailed structure of the present invention have not been revealed in any publication or to the public. As it is believed that the invention would increase job convenience of cosmetician and hair stylists and reduce job-related health problems, a claim is made in compliance with the law.

What is claimed is:

1. A flexible multi-directional beauty salon chair comprising:

a chair, a first vertical rod extending downwardly from a seat of said chair and a horizontal base supporting the opposite end of said rod, the central portion of said rod forming an axle portion;

a supporting arm rotatably mounted on and extending horizontally from the axle portion of said first vertical rod said supporting arm having a first internal horizontal ring gear surrounding said axle portion, first motor means mounted on a partition board connected to said rod and having an output gear in meshed engagement with the internal ring gear for driving said arm in rotational movement around said rod;

a column extending horizontally from an end thereof from said supporting arm, a second threaded rod rotatably mounted horizontally within said column, a second ring gear fixedly mounted within said column adjacent said supporting arm and in meshed engagement with and surrounding an end portion of said second threaded rod, and second motor means engaging said second threaded rod for rotating the same relative to said second fixed ring gear;

a hanging arm mounted at an end of said column opposite said supporting arm and coupled to an end of said second threaded rod opposite said second ring gear, a third rod rotatably and vertically mounted on said hanging arm, said third rod coupled to said hanging arm at one end portion of said third rod the opposite end of said third rod portion being threaded, third motor means engaging said third rod for rotating said rod; a working seat disposed above the threaded end portion of said third rod and a third internal ring gear fixed to the underneath of said working seat and in mesh with the threaded end of said third rod whereby activating said first motor means will cause said column, hanging arm and working seat to rotate horizontally about said chair, activating said second motor means will change the horizontal distance between said chair and working seat and activating said third motor means will move said working seat vertically.

* * * * *